US007520256B2

(12) United States Patent
Omura et al.

(10) Patent No.: US 7,520,256 B2
(45) Date of Patent: Apr. 21, 2009

(54) FASTENING STRUCTURE FOR CYLINDER HEAD AND DIVIDED TYPE CYLINDER BLOCK OF ENGINE

(75) Inventors: Seiji Omura, Toyota (JP); Ken Yamada, Nishio (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 386 days.

(21) Appl. No.: 10/585,968

(22) PCT Filed: Jan. 13, 2005

(86) PCT No.: PCT/JP2005/000631

§ 371 (c)(1),
(2), (4) Date: Jul. 13, 2006

(87) PCT Pub. No.: WO2005/068813

PCT Pub. Date: Jul. 28, 2005

(65) Prior Publication Data

US 2008/0245334 A1 Oct. 9, 2008

(30) Foreign Application Priority Data

Jan. 14, 2004 (JP) ..... 2004-007133

(51) Int. Cl.
*F02F 1/00* (2006.01)

(52) U.S. Cl. ..... 123/193.3

(58) Field of Classification Search ..... 123/193.3, 123/193.2, 193.5

See application file for complete search history.

(56) References Cited

U.S. PATENT DOCUMENTS 3,168,081 A * 2/1965 Bauer ..... 123/41.74
4,446,827 A * 5/1984 Kubozuka ..... 123/195 R
5,005,469 A * 4/1991 Ohta ..... 92/169.4
5,095,868 A * 3/1992 Brighigna ..... 123/193.3
5,562,073 A * 10/1996 Van Bezeij et al. ..... 123/193.2
5,575,251 A * 11/1996 Bock ..... 123/193.3
2005/0151328 A1* 7/2005 Sugano et al. ..... 277/595

FOREIGN PATENT DOCUMENTS

| | | | |
|---|---|---|---|
| DE | 384 095 | C | 11/1923 |
| DE | 31 45 743 | A1 | 8/1982 |
| DE | 198 49 912 | A1 | 3/2000 |
| FR | 551 128 | | 3/1923 |
| JP | 06-213064 | | 8/1994 |
| JP | 2001-295695 | A | 10/2001 |

* cited by examiner

*Primary Examiner*—M. McMahon
(74) *Attorney, Agent, or Firm*—Kenyon & Kenyon LLP

(57) ABSTRACT

A cylinder block 3 of an engine 1 is formed by assembling an inner block member 10 and an outer block member 15. The inner block member 10 includes an upper deck portion 7 integrated with a cylinder liner portion 8. The outer block member 15 includes a cylinder outer wall portion 12. The cylinder head 2 is fastened to an upper deck portion 7 with head bolts 31. The cylinder outer wall portion 12 is fastened to the upper deck portion 7 with block fastening bolts 32 at an opposite side of the upper deck portion 7 with respect to the cylinder head 2. The head bolts 31 and the block fastening bolts 32 are threaded with the upper deck portion 7 from the opposite sides with respect to each other. As a result, deformation of the upper deck portion 7 and inclination of the cylinder liner portion 8 due to fastening of the bolts 31, 32 are reliably prevented.

10 Claims, 6 Drawing Sheets

FASTENING STRUCTURE FOR CYLINDER HEAD AND DIVIDED TYPE CYLINDER BLOCK OF ENGINE

This is a 371 national phase application of PCT/JP2005/000631 filed 13 Jan. 2005 claiming priority to Japanese Application Number 2004-007133 filed 14 Jan. 2004, the contents of which are incorporated herein by reference.

FIELD OF THE INVENTION

The present invention relates to a fastening structure for a cylinder head and a divided type cylinder block of an engine.

BACKGROUND OF THE INVENTION

Typically, a reciprocating internal combustion engine includes a cylinder block having cylinder bores, and a cylinder head. The cylinder head is fixed to the cylinder block with head bolts. When fastening the cylinder head to the cylinder block, the cylinder block can be deformed due to fastening force applied to head bolts.

For example, in a cylinder block having closed deck structure, in which upper end of a cylinder block outer wall portion (cylinder outer wall portion) is connected to the upper end of a cylinder block inner wall portion (cylinder inner wall portion) at an upper deck, fastening the head bolts deforms the upper deck. The cylinder inner wall portion is pressed by the upper deck and inclines inward. As a result, the cylinder bores are deformed.

Conventionally, to prevent a cylinder inner wall portion from inclining inward due to deformation of an upper deck, a structure has been proposed in which sections of the upper deck about through holes for head bolts are thickened compared to the remainder, thereby increasing the rigidity of the upper deck (for example, Japanese Laid-Open Patent Publication No. 6-213064).

However, the structure disclosed in the publication No. 6-213064 is designed for increasing the rigidity of the upper deck, thereby reducing the amount of deformation of the upper deck. Thus, to sufficiently preventing the cylinder inner wall portion from inclining inward, the weight of the cylinder block is unavoidably increased, for example, at the upper deck. That is, such a method for increasing rigidity unavoidably increases the weight of a cylinder block, and thus still has plenty of room for improvement.

SUMMARY OF THE INVENTION

Accordingly, it is an objective of the present invention to provide a fastening structure for a cylinder head and a divided type cylinder block of an engine that reliably prevents a cylinder inner wall portion from inclining inward.

To achieve the foregoing and other objectives and in accordance with the purpose of the present invention, a fastening structure for an engine is provided. The engine includes a cylinder block having a cylinder bore and a cylinder head assembled with the cylinder block. The cylinder block is divided into a cylinder inner wall portion defining the cylinder bore and a cylinder outer wall portion surrounding the cylinder inner wall portion. The cylinder inner wall portion has an integrated upper deck portion. The upper deck portion has a receiving surface on which the cylinder head is placed. The cylinder head is fastened to the upper deck portion with a first bolt. The cylinder outer wall portion is fastened to the upper deck portion with a second bolt at an opposite side of the upper deck portion with respect to the cylinder head. The second bolt fastens the cylinder outer wall portion to the upper deck from an opposite side of the upper deck portion with respect to the first bolt.

The present invention also provides an engine having a cylinder head, a cylinder block, a first bolt, and a second bolt. The cylinder block is assembled with the cylinder head. The cylinder block is divided into an inner block member and an outer block member. The inner block member has a cylinder inner wall portion defining a cylinder bore and an upper deck portion integrally formed with the cylinder inner wall portion. The upper deck portion has a receiving surface on which the cylinder head is placed, and an opposite surface opposite of the receiving surface. The outer block member has a cylinder outer wall portion surrounding the cylinder inner wall portion. The first bolt fastens the cylinder head to the upper deck portion such that the cylinder head contacts the receiving surface. The second bolt fastens the cylinder outer wall portion to the upper deck portion such that the cylinder outer wall portion contacts the opposite surface. The first bolt and the second bolt are threaded to the upper deck portion from the opposite sides of the upper deck portion with respect to each other.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 2(*b*) is a side view illustrating the cylinder block shown in FIG. 2(*a*);

FIG. 4(*b*) is a side view illustrating the inner block member shown in FIG. 4(*a*);

FIG. 5(*b*) is a side view illustrating the outer block member shown in FIG. 5(*a*)

DETAILED DESCRIPTION OF THE PREFERRED EMBODIMENTS

Figure 1:
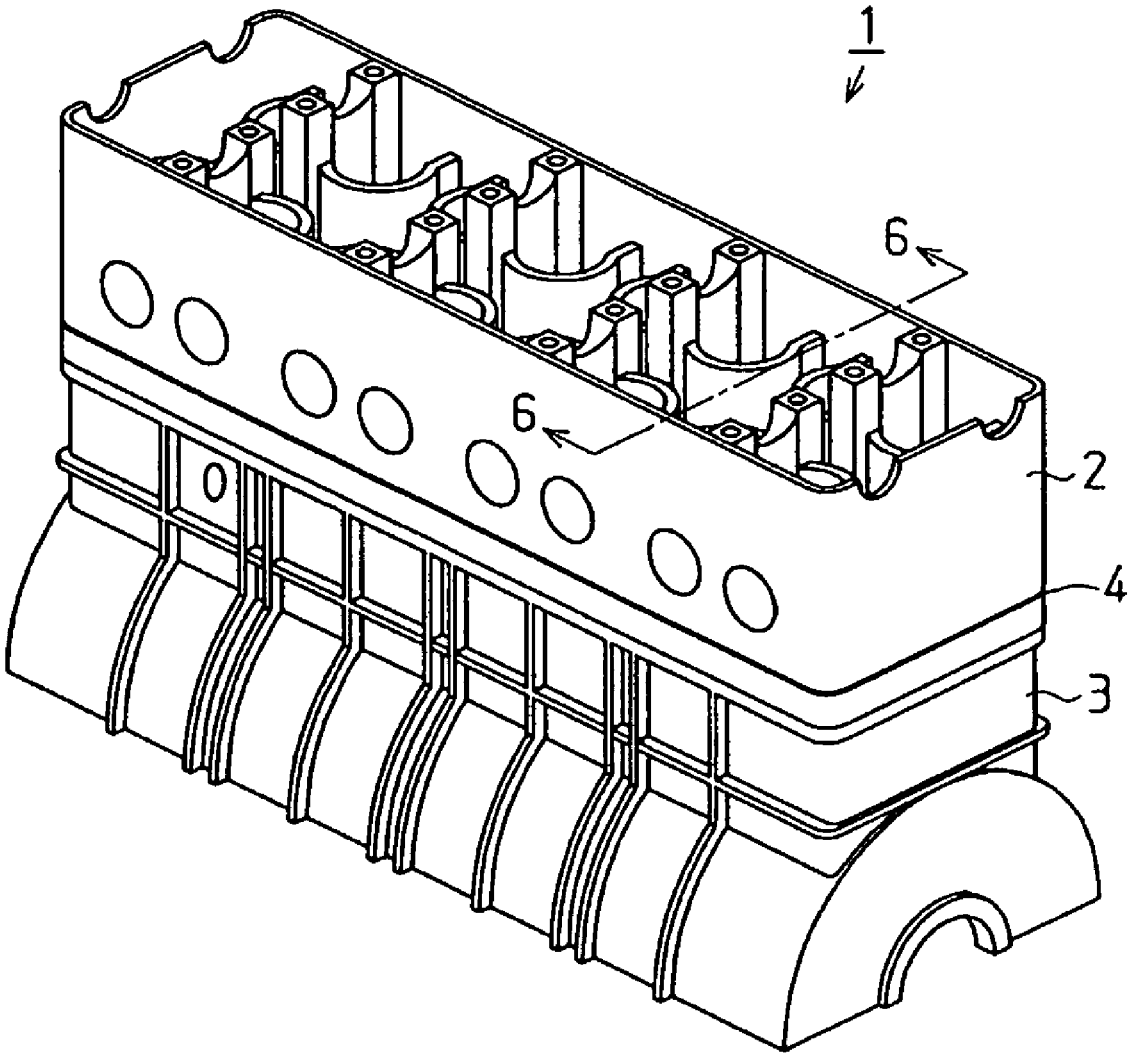
FIG. 1 is a perspective view illustrating a body of an engine according to one embodiment of the present invention.

An in-line four-cylinder engine 1 according to one embodiment of the present invention will now be described referring to the drawings.

As shown in FIG. 1, the engine 1 includes a cylinder head 2 and a divided type cylinder block 3. The cylinder head 2 and the cylinder block 3 are fastened to each other with a gasket 4 in between. Although not illustrated in FIG. 1, a head cover is placed on the cylinder head 2, and an oil pan is attached to the bottom of the cylinder block 3.

Figure 2A:
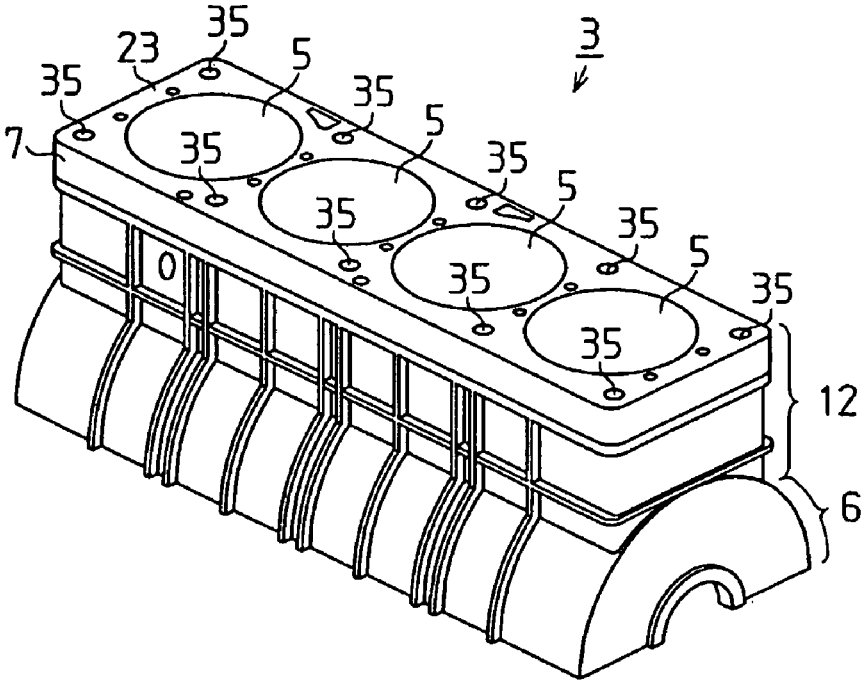
FIG. 2(*a*) is a perspective view illustrating a cylinder block of the engine body shown in FIG. 1.
Figure 2B:
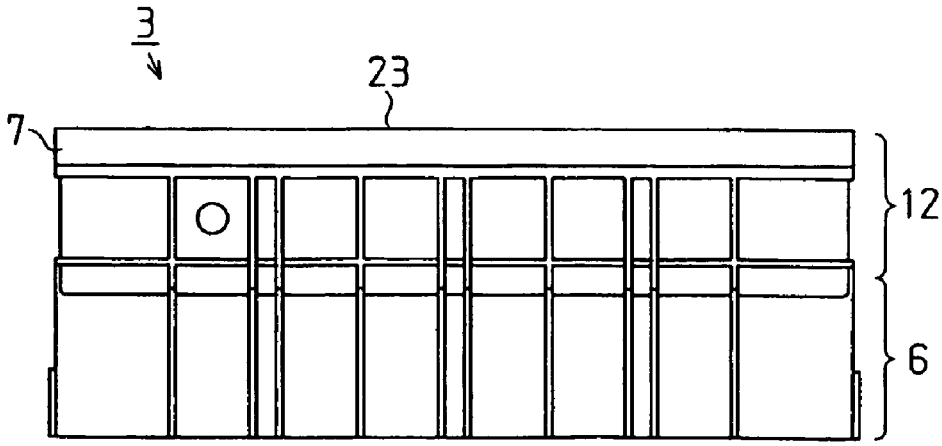

As shown in FIGS. 2(*a*) and 2(*b*), the cylinder block 3 has four cylinder bores 5 formed in an upper portion and a crankcase portion 6 located under the cylinder bores 5. The crankcase portion 6 forms a skirt of the cylinder block 3. The crankcase portion 6, together with the oil pan provided below it, forms a crankcase for accommodating a crankshaft. A flat upper deck portion 7 is formed on the top of the cylinder block 3. The cylinder head 2 is placed on the upper deck portion 7.

Figure 3:
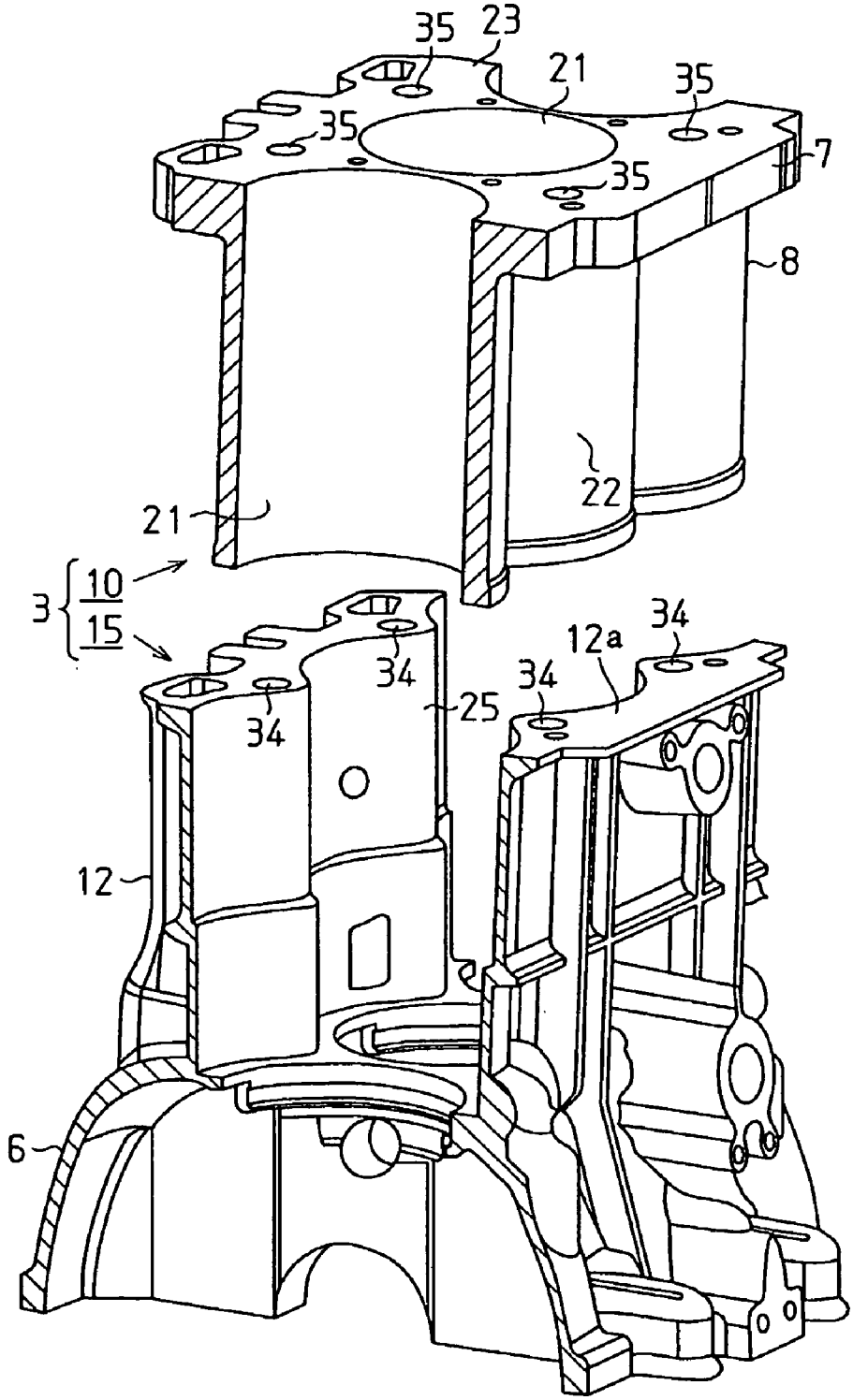
FIG. 3 is an exploded perspective view illustrating the cylinder block shown in FIG. 2(*a*)

As shown in FIG. 3, the cylinder block 3 includes an inner block member 10 and an outer block member 15, which are separate from each other. The inner block member 10 and the outer block member 15 define a water jacket 27 (see FIG. 6) in a middle portion between the upper deck portion 7 and the crankcase portion 6.

The inner block member 10 includes the upper deck portion 7 and a cylinder liner portion 8, which are integrated with each other. The cylinder liner portion 8 forms a cylinder inner wall portion defining the cylinder bores 5. An outer circumferential surface 22 of the cylinder liner portion 8 forms an inner circumferential wall of the water jacket 27. The outer block member 15 includes a cylinder outer wall portion 12 and the crankcase portion 6, which are integrated with each other. The cylinder outer wall portion 12 surrounds the outer circumferential surface 22 of the cylinder liner portion 8, thereby defining the water jacket 27 between the cylinder outer wall portion 12 and the cylinder liner portion 8. An inner circumferential surface 25 of the cylinder outer wall portion 12 forms an outer circumferential wall of the water jacket 27. The cylinder block 3 is formed by assembling the inner block member 10 and the outer block member 15 with each other.

Figure 4A:
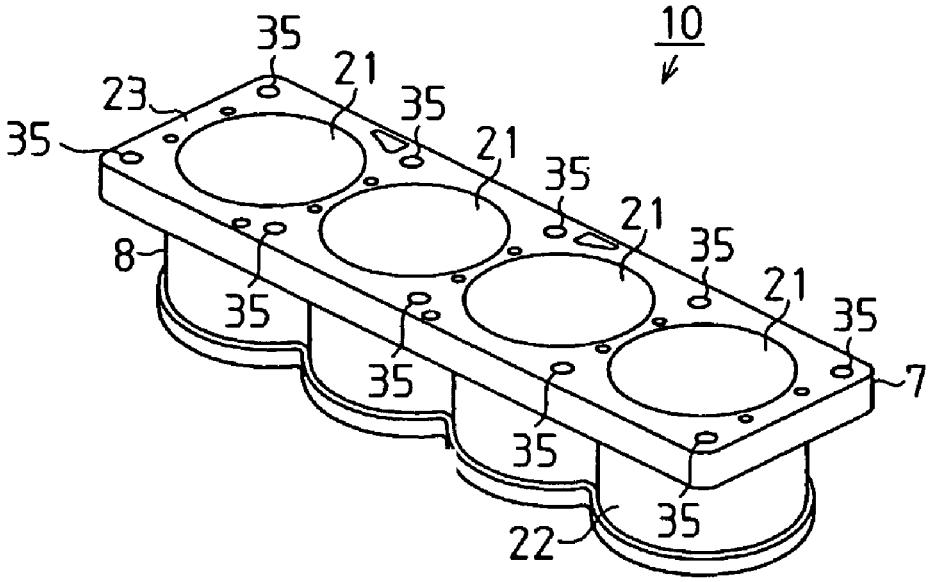
FIG. 4(*a*) is a perspective view illustrating an inner block member forming part of the cylinder block shown in FIG. 3.
Figure 4B:
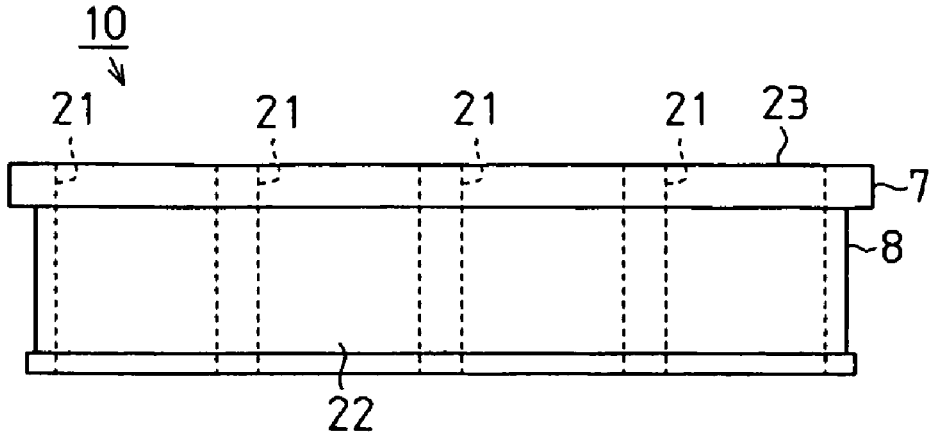

As shown in FIGS. 4(*a*) and 4(*b*), the cylinder liner portion 8 is formed by coupling four cylindrical portions in series. An inner circumferential surface 21 of each cylindrical portion defines one of the cylinder bores 5. When the inner block member 10 is assembled with the outer block member 15, the outer circumferential surface 22 of the cylinder liner portion 8 functions as the inner circumferential wall of the water jacket 27. The upper deck portion 7 is formed as a flat plate at the top of the cylinder liner portion 8. The top surface of the upper deck portion 7 forms a top surface of the cylinder block 3, or a receiving surface 23 on which the cylinder head 2 is placed.

Figure 5A:
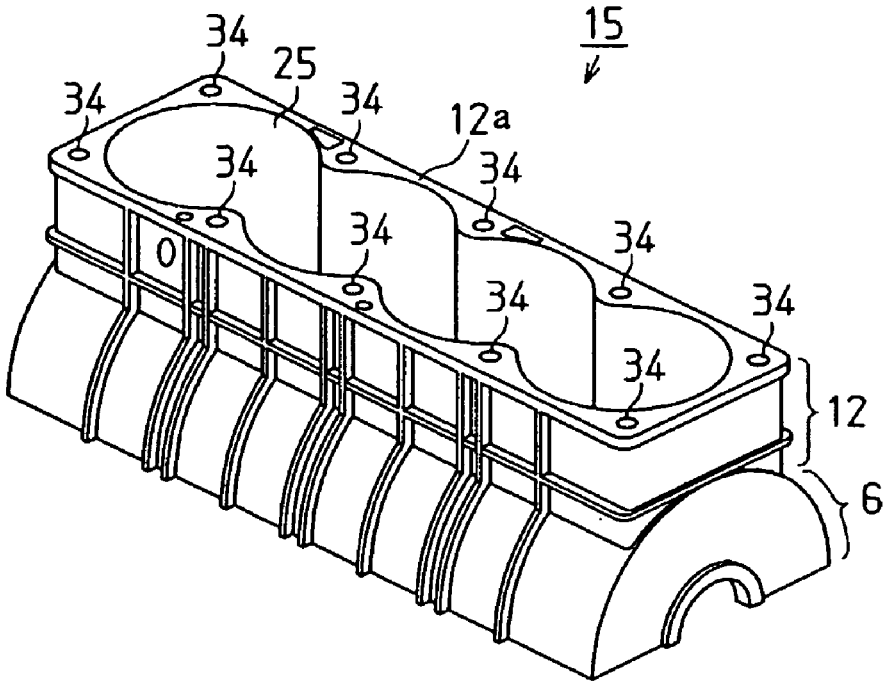
FIG. 5(*a*) is a perspective view illustrating an outer block member forming part of the cylinder block shown in FIG. 3.
Figure 5B:
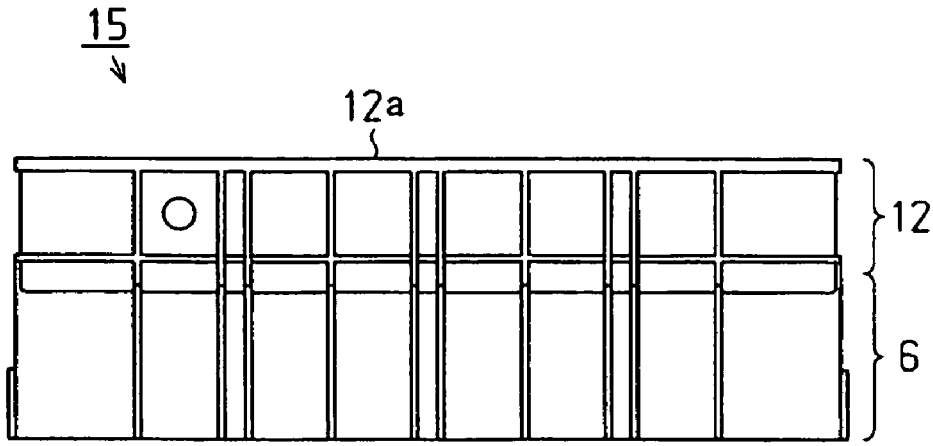

As shown in FIGS. 5(*a*) and 5(*b*), the cylinder outer wall portion 12 projects upward from the crankcase portion 6. The outer wall portion 12 is formed substantially continuously so that its inner circumferential surface 25 faces the outer circumferential surface 22 of the cylinder liner portion 8 with a predetermined space in between. The top surface of the cylinder outer wall portion 12 functions as a receiving surface 12*a* that contacts and supports the upper deck portion 7 of the inner block member 10. When the inner block member 10 is assembled with the outer block member 15, the inner circumferential surface 25 of the cylinder outer wall portion 12 functions as the outer circumferential wall of the water jacket 27.

Assembling and fastening structure of the cylinder head 2 and the cylinder block 3 will now be described.

Figure 6:
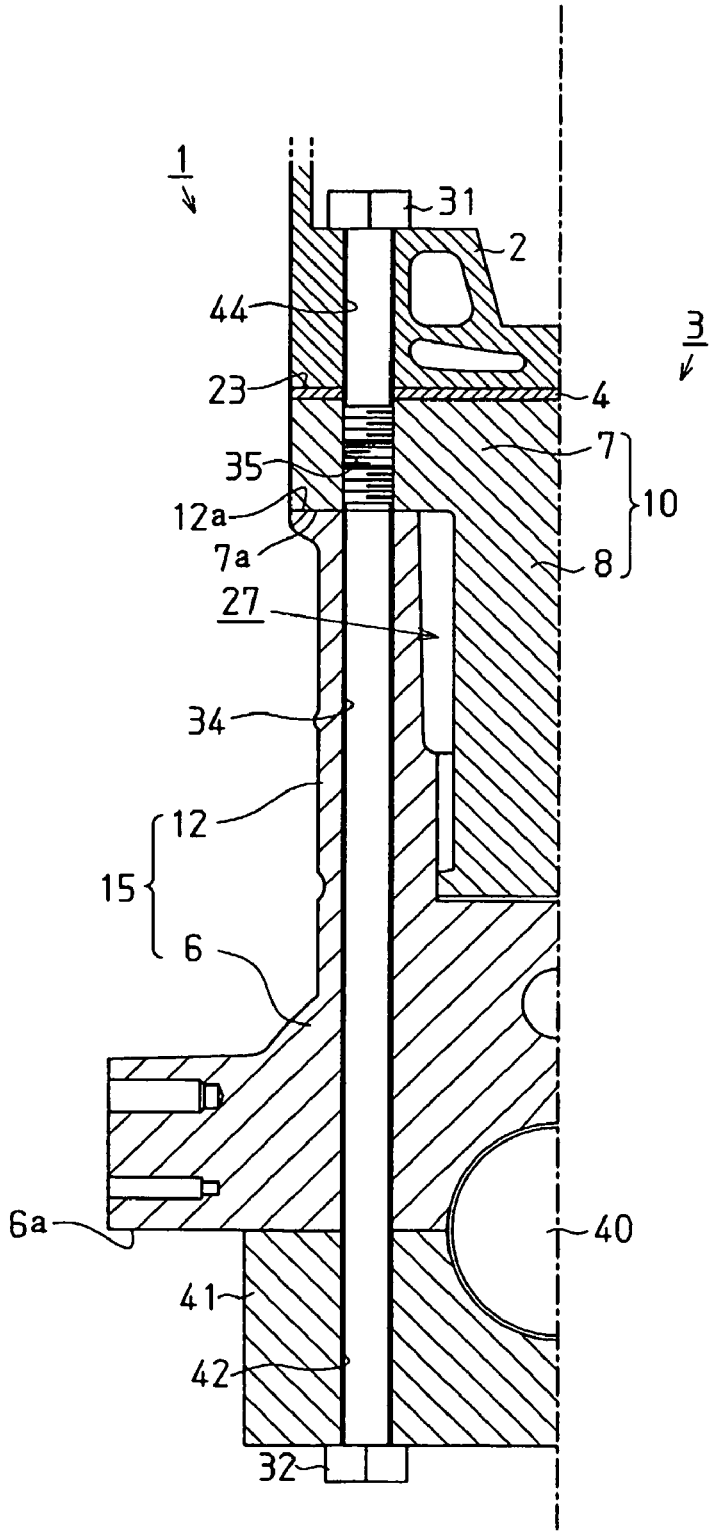
FIG. 6 is a cross-sectional view taken along line 6-6 of FIG. 1.

FIG. 6 is a cross-sectional view illustrating the cylinder head 2 and the cylinder block 3 in an assembled state. As shown in FIG. 6, the inner block member 10 is assembled with the outer block member 15 such that the cylinder liner portion 8 is inserted in a space defined by the cylinder outer wall portion 12 (see FIG. 3), and a lower surface 7*a* of the upper deck portion 7 (a side opposite of the receiving surface 23) contacts the receiving surface 12*a* of the cylinder outer wall portion 12. Accordingly, the outer circumferential surface 22 of the cylinder liner portion 8, the inner circumferential surface 25 of the cylinder outer wall portion 12, and the lower surface 7*a* of the upper deck portion 7 define the water jacket 27 about the cylinder bores 5.

In this embodiment, the cylinder head 2 is fastened to the upper deck portion 7 with first bolts, which are head bolts 31 in this embodiment. The cylinder outer wall portion 12 is fixed to the upper deck portion 7 with second bolts, which are block fastening bolts 32 in this embodiment. The block fastening bolts 32 are attached to the engine 1 from below, or from a side opposite to the side of the head bolts 31.

Specifically, the cylinder outer wall portion 12 has through holes 34, into which the block fastening bolts 32 are inserted. The upper deck portion 7 has bolt threading holes (bolt fastening holes) 35 with which the block fastening bolts 32 are threaded.

In this embodiment, the through holes 34 extend in an up-and-down direction of the cylinder outer wall portion 12, or along the axes of the cylinder bores 5, from the receiving surface 12*a* to the lower surface of the crankcase portion 6, or to a cap receiving surface 6*a*, to which a crank cap 41 for supporting a crankshaft 40 is attached. The crank cap 41 has through holes 42 for receiving the block fastening bolts 32. The through holes 42 are located at positions corresponding to the through holes 34. That is, each through hole 42 is coaxial with the corresponding one of the through holes 34. By inserting the block fastening bolts 32 through the through holes 42, 34 and threading the bolts 32 with the bolt threading holes 35, the cylinder outer wall portion 12 is fastened to the upper deck portion 7, and the crank cap 41 is fixed to the cap receiving surface 6*a*.

That is, in this embodiment, the block fastening bolts 32 also function to fix the crank cap 41, which support the crankshaft 40, to the crankcase portion 6. The cylinder outer wall portion 12 is fastened to the upper deck portion 7 while being held between the lower surface 7*a* of the upper deck portion 7 and the crank cap 41 (and the crankcase portion 6).

On the other hand, the cylinder head 2 has through holes 44. The cylinder head 2 is fastened to the upper deck portion 7 with the head bolts 31, which are inserted into the through holes 44. In this embodiment, the through holes 44 are formed such that the axis of each head bolt 31 is aligned with the axis of the corresponding one of the block fastening bolts 32.

Specifically, the through holes 44 of the cylinder head 2 are formed at positions corresponding to the positions of the bolt threading holes 35. That is, the through holes 44 are coaxial with the bolt threading holes 35. Thread is formed in each bolt threading hole 35 not only at a section from the lower surface 7*a* of the upper deck portion 7, but also at a section from the upper surface of the upper deck portion 7, or the receiving surface 23, on which the cylinder head 2 is placed. The cylinder head 2 is fastened to the cylinder block 3 by inserting the head bolts 31 into the through holes 44 and threading the head bolts 31 to the bolt threading holes 35.

Accordingly, the cylinder head 2 is fastened to the upper deck portion 7 with the head bolts 31 while using the receiving surface 23 of the upper deck portion 7 as a fastening surface. The cylinder outer wall portion 12 is fastened to the upper deck portion 7 with the block fastening bolts 32 while using a surface of the upper deck portion 7 opposite to the receiving surface 23, or the lower surface 7*a* of the upper deck portion 7, as a fastening surface.

The present embodiment has the following advantages.

(1) The engine 1 includes the cylinder head 2 and the cylinder block 3. The cylinder block 3 is formed by assembling the inner block member 10 and the outer block member 15. The inner block member 10 includes the upper deck portion 7 and the cylinder liner portion 8, which forms the cylinder inner wall portion. The outer block member 15 includes the cylinder outer wall portion 12. The cylinder head 2 is fastened to the upper deck portion 7 with the head bolts 31, which function as the first bolts. The cylinder outer wall portion 12 is fastened to the upper deck portion 7 with the block fastening bolts 32, which are the second bolts, at an opposite side of the upper deck portion 7 with respect to the cylinder head 2. In other words, the cylinder block 3 and the cylinder head 2 are assembled with the upper deck portion 7 being held between the cylinder head 2 and the cylinder outer wall portion 12. The head bolts 31 and the block fastening bolts 32 are coupled to (threaded with) the upper deck portion 7 from the opposite sides with respect to each other.

According to this configuration, fastening force of the head bolts 31 and fastening force of the block fastening blots 32 act on the upper deck portion 7 in opposite directions and cancel each other. This minimizes deformation of the upper deck portion 7 due to the fastening forces. Thus, the cylinder liner portion 8 is prevented from being inclined by fastening of the bolts 31, 32. The fastening forces of the head bolts 31 and the block fastening bolts 32 are preferably set equal to each other to prevent the cylinder liner portion 8 from being inclined.

(2) The axis of each head bolt 31 is aligned with the axis of the corresponding block fastening bolt 32. This configuration prevents couple from being generated by fastening each head bolt 31 and the corresponding block fastening bolt 32. Accordingly, inclination of the cylinder liner portion 8 due to the couple is further reliably prevented.

(3) The block fastening bolts 32 and the head bolts 31 are threaded to the common bolt threading holes 35. Therefore, compared to a case where separate sets of holes are formed for each of the block fastening bolts 32 and the head bolts 31, the structure is simplified. Also, the axes of each block fastening bolt 32 and the corresponding head bolt 31 are easily aligned.

(4) The block fastening bolts 32 also functions to fix the crank cap 41, which support the crankshaft 40, to the crankcase portion 6. This reduces the number of the components and simplifies the structure.

The above described embodiments may be modified as follows.

In the illustrated embodiment, the through holes 34 extend from the receiving surface 12*a* of the cylinder outer wall portion 12 to the cap receiving surface 6*a* of the crankcase portion 6. The upper deck portion 7 is fastened to the cylinder outer wall portion 12 with the block fastening bolts 32 inserted into the through holes 42 and the through holes 34. However, the block fastening bolts 32 may be separately formed from bolts for fastening the crank cap 41 to the crankcase portion 6. In this case, the through holes 34 do not need to extend to the crankcase portion 6.

In this embodiment, the axis of each head bolt 31 is aligned with the axis of the corresponding block fastening bolt 32. However, these axes do not need to be aligned.

In the illustrated embodiment, the block fastening bolts 32 and the head bolts 31 are threaded to the common bolt threading holes 35. However, bolt threading holes for the block fastening bolts 32 and bolt threading holes for the head bolts 31 may be separately formed in the upper deck portion 7.

The invention claimed is:

1. A fastening structure for an engine, the engine including a cylinder block having a cylinder bore and a cylinder head assembled with the cylinder block, wherein the cylinder block is divided into a cylinder inner wall portion defining the cylinder bore and a cylinder outer wall portion surrounding the cylinder inner wall portion, wherein the cylinder inner wall portion has an integrated upper deck portion, the upper deck portion having a receiving surface on which the cylinder head is placed, and wherein the cylinder head is fastened to the upper deck portion with a first bolt, the cylinder outer wall portion is fastened to the upper deck portion with a second bolt at an opposite side of the upper deck portion with respect to the cylinder head, and the first bolt and the second bolt are threaded to the upper deck portion from the opposite sides of the upper deck portion with respect to each other.

2. The fastening structure according to claim 1, wherein the first bolt and the second bolt are coaxial.

3. The fastening structure according to claim 2, wherein the upper deck portion has a common bolt threading hole, wherein the first bolt and the second bolt are threaded to the common bolt threading hole while opposing to each other.

4. The fastening structure according to claim 1, wherein the cylinder head includes a through hole into which the first bolt is inserted, and the cylinder outer wall portion includes a through hole into which the second bolt is inserted.

5. The fastening structure according to claim 1, wherein the cylinder outer wall portion has an integrated crankcase portion, the engine has a crankshaft and a crank cap for supporting the crankshaft, and the second bolt also functions as a bolt for fixing the crank cap to the crankcase portion.

6. An engine comprising:

a cylinder head;

a cylinder block assembled with the cylinder head, wherein the cylinder block is divided into an inner block member and an outer block member, the inner block member having a cylinder inner wall portion defining a cylinder bore and an upper deck portion integrally formed with the cylinder inner wall portion, the upper deck portion having a receiving surface on which the cylinder head is placed, and an opposite surface opposite of the receiving surface, the outer block member having a cylinder outer wall portion surrounding the cylinder inner wall portion;

a first bolt that fastens the cylinder head to the upper deck portion such that the cylinder head contacts the receiving surface; and a second bolt that fastens the cylinder outer wall portion to the upper deck portion such that the cylinder outer wall portion contacts the opposite surface, wherein the first bolt and the second bolt are threaded to the upper deck portion from the opposite sides of the upper deck portion with respect to each other.

7. The engine according to claim 6, wherein the first bolt and the second bolt are coaxial.

8. The engine according to claim 7, wherein the upper deck portion has a common bolt threading hole, wherein the first bolt and the second bolt are threaded to the common bolt threading hole while opposing to each other.

9. The engine according to claim 6, wherein the cylinder head includes a through hole into which the first bolt is inserted, and the cylinder outer wall portion includes a through hole into which the second bolt is inserted.

10. The engine according to claim 6, further comprising a crankshaft and a crank cap for supporting the crankshaft, wherein the outer block member includes a crankcase portion integrally formed with the cylinder outer wall portion, and the second bolt also functions as a bolt for fixing the crank cap to the crankcase portion.

* * * * *